US010006418B2

(12) United States Patent
Kim et al.

(10) Patent No.: US 10,006,418 B2
(45) Date of Patent: Jun. 26, 2018

(54) INTAKE MANIFOLD FOR VEHICLE WITH UNIFIED GAS FLOW PATH

(71) Applicant: HYUNDAI KEFICO CORPORATION, Gyeonggi-do (KR)

(72) Inventors: Hyung-Wook Kim, Gyeonggi-do (KR); Young-Dae Min, Incheon (KR)

(73) Assignee: HYUNDAI KEFICO CORPORATION, Gyeonggi-do (KR)

( * ) Notice: Subject to any disclaimer, the term of this patent is extended or adjusted under 35 U.S.C. 154(b) by 0 days. days.

(21) Appl. No.: 15/258,524

(22) Filed: Sep. 7, 2016

(65) Prior Publication Data

US 2017/0082074 A1 Mar. 23, 2017

(30) Foreign Application Priority Data

Sep. 18, 2015 (KR) ..... 10-2015-0132490

(51) Int. Cl.

| | |
|---|---|
| ***F02M 35/10*** | (2006.01) |
| ***F01M 13/00*** | (2006.01) |
| ***F02M 35/104*** | (2006.01) |
| ***F01M 13/02*** | (2006.01) |

(52) U.S. Cl.

CPC .. *F02M 35/10222* (2013.01); *F01M 13/0011* (2013.01); *F01M 13/023* (2013.01); *F02M 35/104* (2013.01); *F02M 35/10026* (2013.01); *F02M 35/10078* (2013.01)

(58) Field of Classification Search

CPC ..... F02M 25/089; F02M 35/104; F02M 25/0836; F02M 26/17; F02M 35/10026; F02M 35/10072; F02M 35/10255; F02M 35/10039; F02M 35/10091

See application file for complete search history.

(56) References Cited

U.S. PATENT DOCUMENTS

| | | | | |
|---|---|---|---|---|
| 8,210,146 | B2 * | 7/2012 | Horie | F02M 35/10085 123/184.31 |
| 2009/0293831 | A1 * | 12/2009 | Harada | F02M 35/10085 123/184.53 |
| 2010/0071985 | A1 * | 3/2010 | Harada | B60T 8/3685 180/219 |
| 2010/0101514 | A1 | 4/2010 | Hirano et al. | |
| 2014/0326226 | A1 | 11/2014 | Senda et al. | |

(Continued)

FOREIGN PATENT DOCUMENTS

| | | | |
|---|---|---|---|
| JP | 2001140713 A | * | 5/2001 |
| JP | 2014-040801 | | 3/2014 |
| JP | 2015-068190 | | 4/2015 |

*Primary Examiner* — Long T Tran

(74) *Attorney, Agent, or Firm* — Wells St. John P.S.

(57) ABSTRACT

Disclosed is an intake manifold for a vehicle with a unified flow path. The intake manifold has a plurality of branch pipes connected to intake ports of cylinders of an automotive engine, and a surge tank unit connected to the branch pipes and having an external air inlet formed at a side to receive external air, in which the surge tank unit has a unified gas inlet formed at the external air inlet so that blow-by gas an fuel evaporation gas both flows inside. Accordingly, flow resistance when external air flows inside is reduced and freezing at the blow-by gas inlet is prevented in winter. Therefore, the amount of air mixture to be supplied into the cylinders is increased, whereby the volume efficiency of the cylinders is improved and engine torque is increased.

6 Claims, 9 Drawing Sheets

(56) References Cited

U.S. PATENT DOCUMENTS

| | | | | |
|---|---|---|---|---|
| 2015/0041699 | A1* | 2/2015 | Shigematsu ..... | F02M 35/10255<br>251/306 |
| 2015/0114369 | A1* | 4/2015 | Tanikawa ..... | F01M 13/023<br>123/574 |
| 2015/0184581 | A1 | 7/2015 | Nakasugi et al. | |
| 2015/0322867 | A1* | 11/2015 | Ito ..... | F02M 35/10262<br>123/184.21 |
| 2016/0201620 | A1* | 7/2016 | Yano ..... | F02M 35/10321<br>123/184.27 |

* cited by examiner

INTAKE MANIFOLD FOR VEHICLE WITH UNIFIED GAS FLOW PATH

CROSS REFERENCE TO RELATED APPLICATION(S)

This application claims the benefit of Korean Patent Application No. 10-2015-0132490, filed on Sep. 18, 2015, which is hereby incorporated by reference in its entirety into this application.

BACKGROUND OF THE INVENTION

1. Technical Field

The present invention relates generally to an intake manifold for a vehicle with a unified gas flow path and, more particularly, to an intake manifold for a vehicle with a unified gas flow path in which the flow path of a PCV valve connector for receiving blow-by gas and the flow path of a PCSV connector for receiving fuel evaporation gas are integrated.

2. Description of the Related Art

In general, an automotive engine has one or more cylinders each being constituted by a cylinder head and a cylinder block, and kinetic energy produced by combustion of a gas mixture of fuel and air with an appropriate ratio in the cylinders is used for driving a vehicle.

The cylinders of the automotive engine are connected to an intake manifold, so the intake manifold is a part of the automotive engine for supplying the mixture of fuel/air into the cylinders.

The intake manifold is a part for uniformly distributing a combustion mixture (or air in a direct injection engine) to intake ports of the cylinder heads.

Meanwhile, combustion gas and non-combustion gas produced by explosion in the cylinders of an engine flows into a crankcase through the gaps between pistons and the cylinder liners and this gas is called blow-by gas. The inside of the engine is corroded or engine oil is easily changed in quality by the blow-by gas. Accordingly, a blow-by gas recirculation system that circulates blow-by gas into the cylinders of an engine by sending it back to the intake side is installed.

Blow-by gas in a crankcase is sent into the intake manifold of a vehicle through a PCV (Positive Crankcase Ventilation) by such a blow-by gas recirculation system. The blow-by gas sent in the intake manifold is mixed with fresh air in the intake manifold and then flows back into the cylinders of the engine.

Further, fuel evaporation gas produced in a fuel tank is collected and kept in a canister, sent into a serge tank of the intake manifold through a purge control solenoid valve (hereafter, referred to as a PCSV), and then supplied into the cylinders.

The PCSV is a valve for diffusing fuel evaporation gas produced in a fuel tank and collected in a canister to the engine.

FIGS. 1 to 3 show an automotive intake manifold of the related art. Referring to FIGS. 1 to 3, an automotive intake manifold 1' has a plurality of branch pipes 10' connected to the intake ports of the cylinders of an automotive engine, and a surge tank unit 20' that is connected to the branch pipes 10' and has an external air inlet formed at a side to receive external air.

A blow-by gas inlet 20*a* and an evaporation gas inlet 20*b* are formed with a predetermined interval in the surge tank unit 20' of the automotive intake manifold 1' so that blow-by gas and fuel evaporation gas flows into the surge tank unit 20'.

The blow-by gas inlet 20*a* is connected to a PCV valve connector 30' protruding to connect a PCV valve and the evaporation gas inlet is connected to a PCSV connector 40' protruding to connect a PCSV.

Further, the blow-by gas inlet 20*a* and the evaporation gas inlet 20*b* are spaced from each other at an external air inlet 23' of the surge tank unit 20' so that external air, blow-by gas, and evaporation gas can be mixed well in the surge tank unit 20'.

However, since the blow-by gas inlet 20*a* and the evaporation gas inlet 20*b* are spaced from each other at the external inlet 23' in the automotive intake manifold 1' of the related art, when external air flows into the surge tank 20 through the external air inlet, a loss of pressure of the air is caused by flow resistance, so the external air cannot smoothly flow into the surge tank unit 20, and accordingly, air cannot be sufficiently supplied into cylinders.

Further, according to the automotive intake manifold 1' of the related art, since high-temperature blow-by gas is supplied into the surge tank unit through the blow-by gas inlet 20*a*, condensate water is produced in the blow-by gas inlet 20*a* when the high-temperature blow-by gas is mixed with cold external air in winter and, the condensate water partially or fully blocks the blow-by gas inlet 20*a* by freezing.

SUMMARY OF THE INVENTION

Accordingly, the present invention has been made keeping in mind the above problems occurring in the prior art, and an object of the present invention is to provide an intake manifold for a vehicle with a unified flow path in which blow-by gas and fuel evaporation gas flows into a surge tank through one inlet, thereby reducing flow resistance when external air flows inside and preventing freezing in the surge tank.

In order to accomplish the above object, the present invention provides an intake manifold for a vehicle with a unified flow path, the intake manifold having a plurality of branch pipes connected to intake ports of cylinders of an automotive engine, and a surge tank unit that is connected to the branch pipes and has an external air inlet formed at a side to receive external air, in which the surge tank unit has a unified gas inlet formed at the external air inlet so that blow-by gas and fuel evaporation gas both flows inside.

The intake manifold may have a PCV valve connector protruding to mount a PCV valve for receiving blow-by gas into the surge tank unit and a PCSV connector protruding to mount a PCSV for receiving fuel evaporation gas into the surge tank unit.

A flow path wall forming a blow-by gas flow path connected to the PCV valve connector, and guiding blow-by gas, which flows inside through the PCV valve connector, into the external inlet of the surge tank unit may be formed in the surge tank unit, the unified gas inlet may be formed at an end of the flow path wall, and an outlet of the PCSV connector may be disposed inside the unified gas inlet.

A gas cap member for opening and closing the blow-by gas flow path may be coupled to the surge tank unit and the PCSV connector may be integrally formed with the gas cap member.

The PCSV connector may be disposed at a portion, which corresponds to the unified gas inlet, of the gas cap member.

The PCSV connector may have a gas outlet protruding inside the unified gas inlet.

The PCSV connector may have an anti-backflow wall protruding at a joint with the outlet of the PCSV connector in a gas flow direction inside the blow-by gas flow path to guide the blow-by gas to the unified gas inlet.

The gas outlet may be disposed fully inside the unified gas inlet.

The gas outlet may be disposed at the external air inlet in the unified gas inlet and a blow-by gas intake portion may be disposed behind the gas outlet in the unified gas inlet.

According to the present invention, since blow-by gas and fuel evaporation gas flow together inside through one gas inlet formed at the external inlet of the surge tank unit, flow resistance when external air flows inside is reduced.

Further, since flow resistance when external air flows into the surge tank unit is reduced, a loss of pressure of the external air is minimized and the amount of air to be supplied into the cylinders of an automotive engine is correspondingly increased. Accordingly, the volume efficiency of the cylinders is improved and engine torque is increased.

Further, since blow-by gas and fuel evaporation gas flow together inside through one gas inlet formed at the external air inlet of the surge tank unit, high-temperature blow-by gas is primarily cooled while being mixed with fuel evaporation gas and then meets external air. Accordingly, condensate water is prevented and freezing of condensate water is correspondingly prevented in winter.

Further, blow-by gas is smoothly guided by preventing freezing at the blow-by gas inlet in winter, so the amount of air to be supplied into the cylinders of an automotive engine is increased. Accordingly, the volume efficiency of the cylinders is improved and engine torque is increased.

Further, since the PCSV connector is integrated with the gas cap member for covering the blow-by gas flow path for guiding blow-by gas to the inlet for external air, molds are unified in a single unit and the manufacturing process is correspondingly simplified. Accordingly, the manufacturing cost is reduced.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
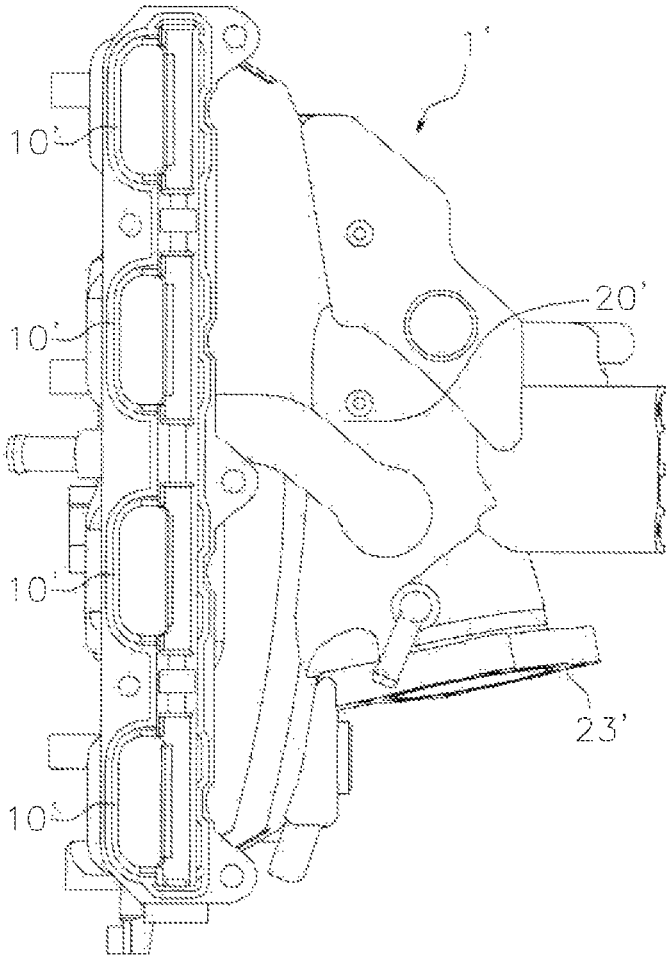
FIG. 1 is a front view of an automotive intake manifold of the related art.
Figure 2:
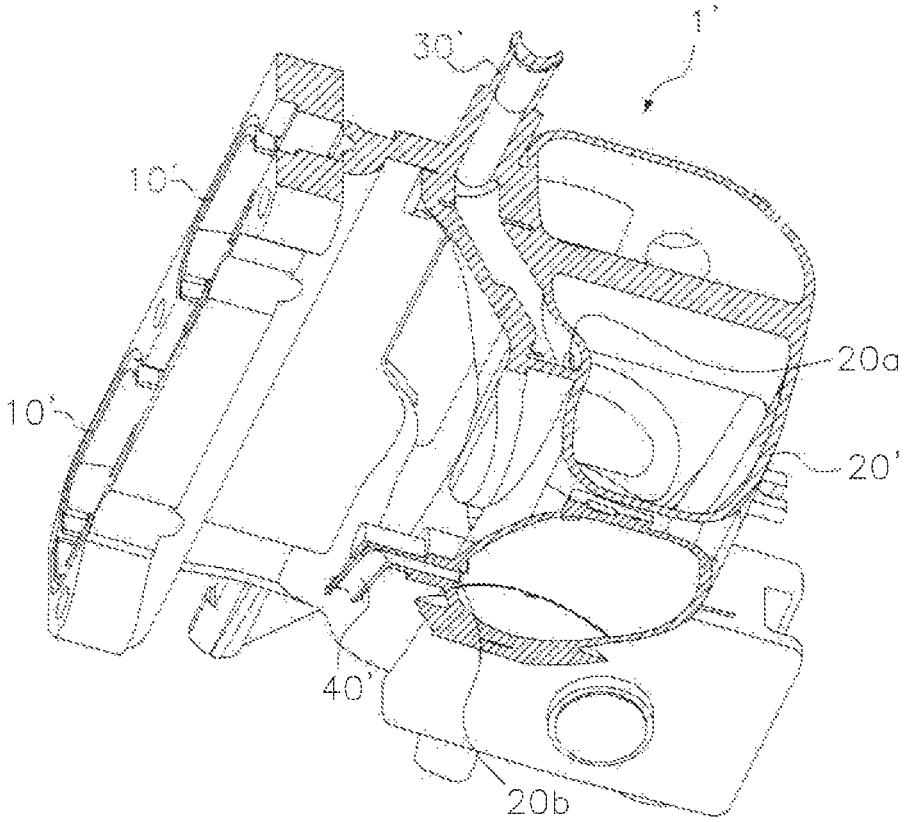
FIGS. 2 and 3 are cross-sectional perspective view of the automotive intake manifold of the related art.
Figure 3:
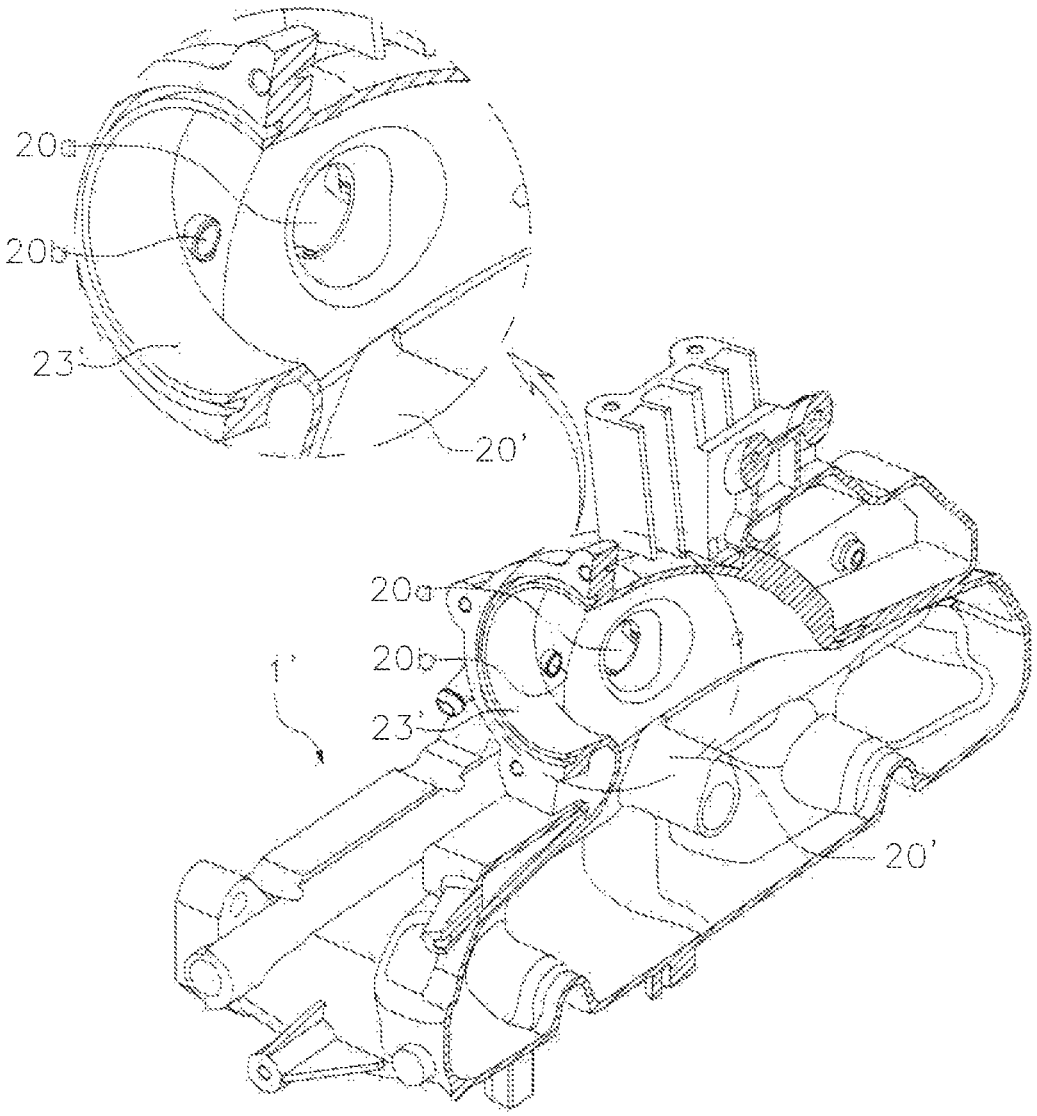

The present invention will be described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clearer.

Figure 4:
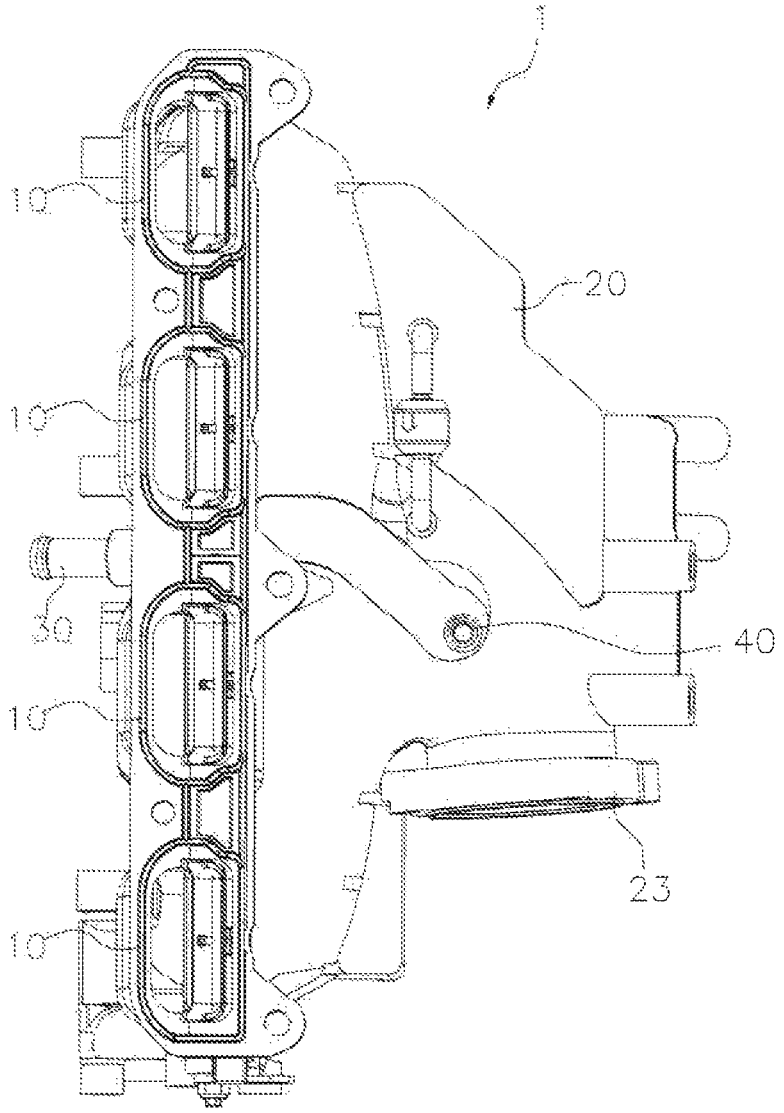
FIG. 4 is a front view of an intake manifold with a unified flow path according to an embodiment of the present invention.
Figure 5:
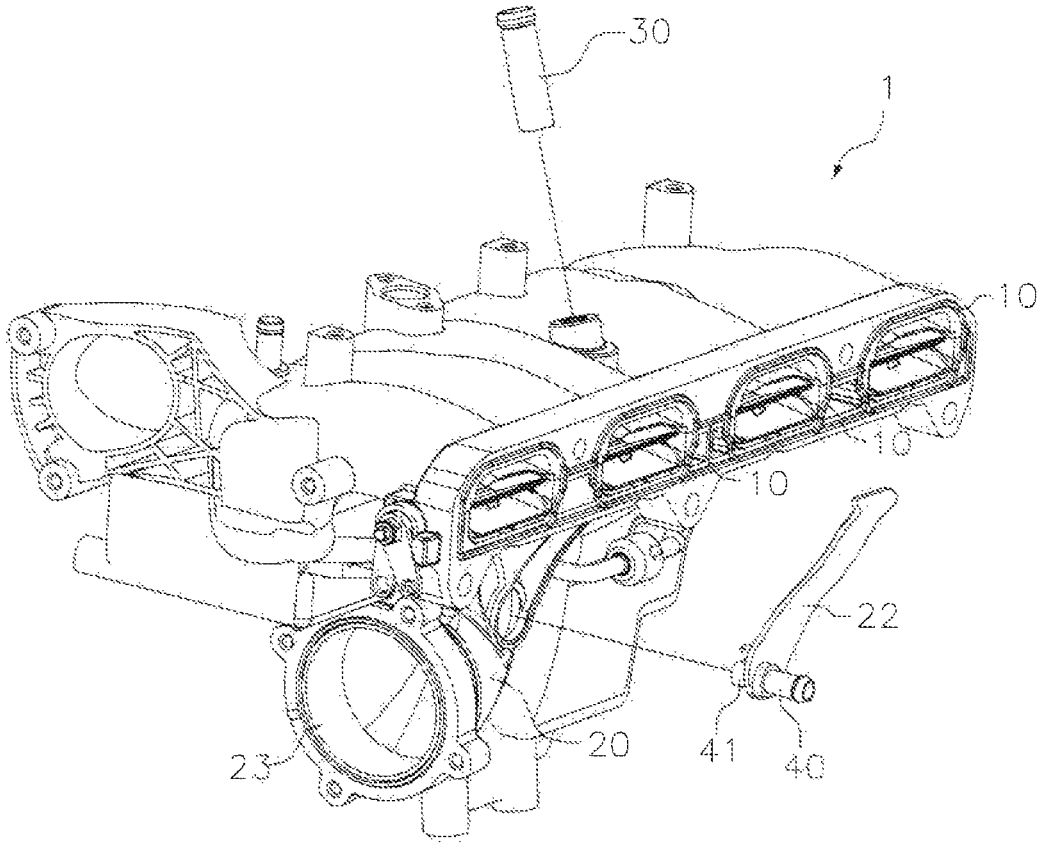
FIG. 5 is a perspective view of the intake manifold with a unified flow path according to an embodiment of the present invention.

FIG. 4 is a front view of an intake manifold 1 with a unified flow path according to an embodiment of the present invention and FIG. 5 is a perspective view of the intake manifold 1 with a unified flow path according to an embodiment of the present invention. Referring to FIGS. 4 and 5, the intake manifold 1 with a unified flow path according to an embodiment of the present invention has a plurality of branch pipes 10 that are connected to the intake ports of the cylinders of an automotive engine, and a surge tank unit 20 that is connected to the branch pipes 10 and has an external air inlet formed at a side to receive external air.

The branch pipes 10 are opened and closed by a VCM (Variable Charge Motion) valve, which is the same configuration as common automotive intake manifolds, so detailed description is not provided.

The intake manifold 1 with a unified flow path according to an embodiment of the present invention has a PCV valve connector 30 protruding to mount a PCV valve for receiving blow-by gas into the surge tank unit 20 and a PCSV connector 40 protruding to mount a PCSV for receiving fuel evaporation gas into the surge tank unit 20.

For example, the PCV valve connector 30 is a nipple for connecting a PCV valve and the PCSV connector 40 is a nipple for connecting a PCSV.

Figure 6:
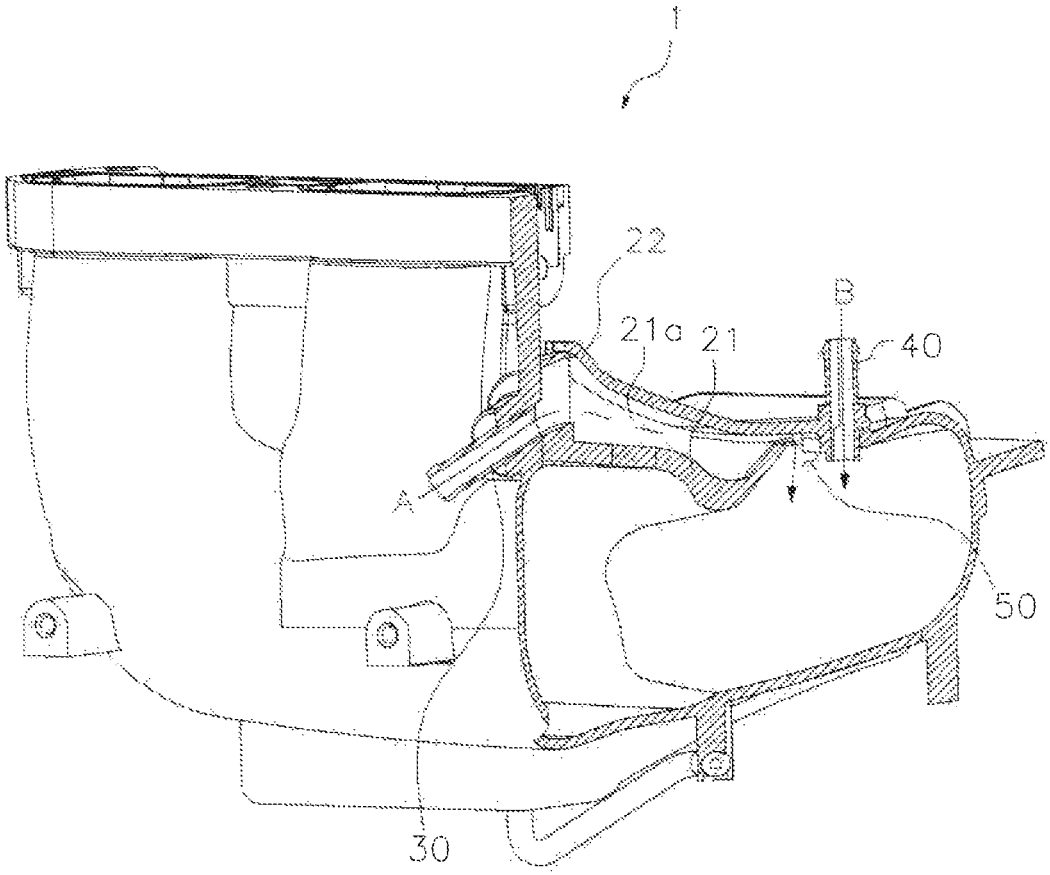
FIG. 6 is a cross-sectional perspective view of the intake manifold with as unified flow path according to an embodiment of the present invention.
Figure 7:
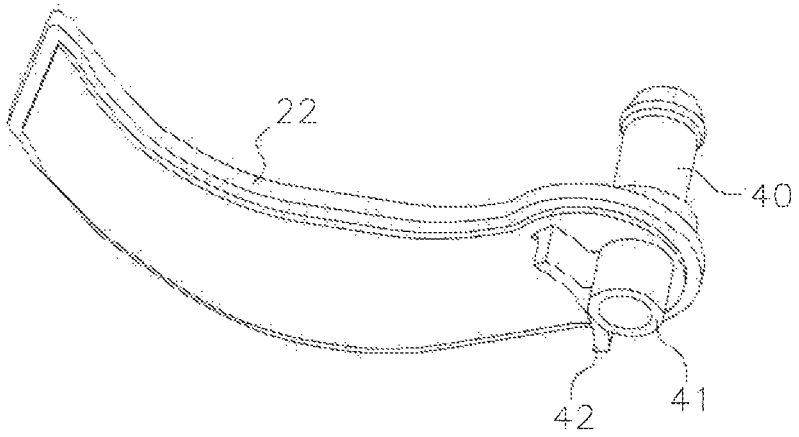
FIG. 7 is a perspective view of an example of a gas cap member in the intake manifold with a unified flow path according to an embodiment of the present invention.

FIG. 6 is a cross-sectional perspective view of the intake manifold 1 with a unified flow path according to an embodiment of the present invention and FIG. 7 is a perspective view of an example of a gas cap member 22 in the intake manifold 1 with a unified flow path according to an embodiment of the present invention.

The intake manifold 1 with a unified flow path according to an embodiment of the present invention has a unified gas inlet 50 formed at the external inlet 23 of the surge tank unit 20 so that blow-by gas and fuel evaporation gas can flow together into the surge tank 20.

The PCV valve connector 30 protrudes at a portion dose to the inlets of the branch pipes 10 and shares the inlets of the branch pipes 10. A flow path wall 21 forming a blow-by gas flow path 21*a* connected to the PCV valve connector 30 and guiding blow-by gas, which flows inside through the PCV valve connector 30, into the external inlet 23 of the surge tank unit 20 is formed in the surge tank unit 20.

The unified gas inlet 50 is formed at an end, that is, the end close to the external air inlet 23, of the flow path wall 21.

Further, an outlet of the PCSV connector 40 is disposed inside the unified gas inlet 50.

Blow-by gas flows in the direction A through the blow-by gas flow path 21*a* to be guided into the unified gas inlet 50, while fuel evaporation gas flows in the direction B through the PCSV connector 40 to be guided into the unified gas inlet 50.

That is, the unified gas inlet 50 is formed at the end of the blow-by gas flow path 21*a*, so the blow-by gas flowing inside through the blow-by gas inlet 21*a* flows into the surge tank 20. Further, the outlet of the PCSV connector 40 is disposed inside the unified gas inlet 50, so the fuel evaporation gas discharged through the outlet of the PCSV connector 40 flows into the surge tank 20.

A gas cap member 22 for opening/closing the blow-by gas flow path 21*a* is coupled to the surge tank unit 20 and the PCSV connector 40 may be integrated with the gas cap member 22. Further, the PCSV connector 40 may be disposed at a portion, which corresponds to the unified gas inlet 50, of the gas cap member 22 so that the outlet thereof can be directly connected to the unified gas inlet 50.

The PCSV connector 40 has a gas outlet 41 protruding into the unified gas inlet 50, so it prevents gas flowing inside through the blow-by gas flow path 21*a* from flowing backward into a canister, which keeps fuel evaporation gas, through the outlet of the PCSV connector 40.

The PCSV connector 40 may have an anti-backflow wall 42 protruding at the joint with the outlet of the PCSV connector 40 in a gas flow direction inside the blow-by gas flow path 21*a* to guide the blow-by gas to the unified gas inlet 50.

The anti-backflow wall 42 further prevents the blow-by gas flowing inside through the blow-by gas flow path 21*a* from flowing backward into the canister keeping fuel evaporation gas through the outlet of the PCSV connector 40.

The anti-backflow wall 42 is integrally formed at a side of the gas outlet 41 to block the gas outlet 41 and guide the blow-by gas to the unified gas inlet 50 so that the blow-by gas can flow into the surge tank 20.

Figure 8:
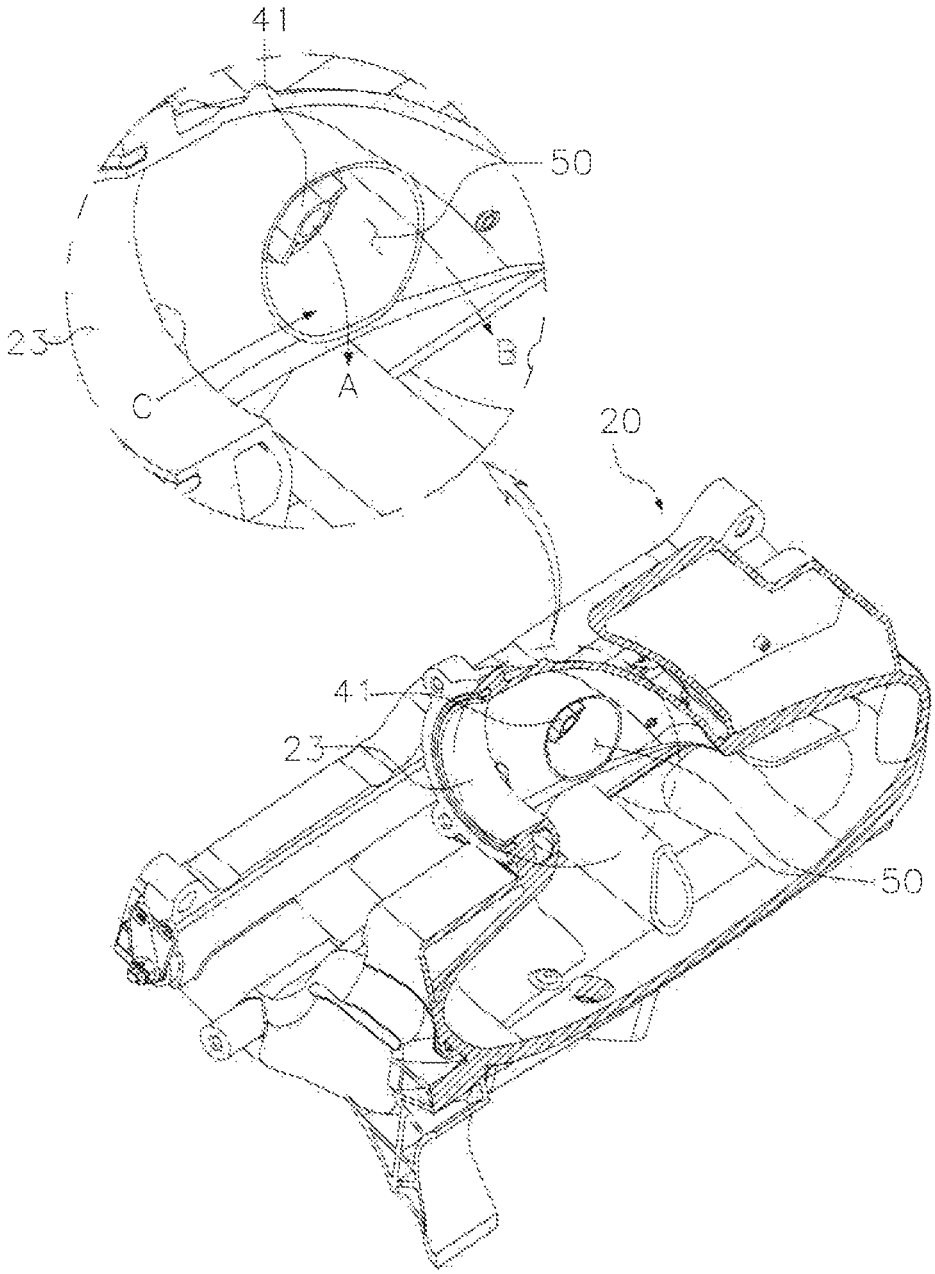
FIG. 8 is a cross-sectional perspective view of a surge tank unit in the intake manifold with a unified flow path according to an embodiment of the present invention.
Figure 9:
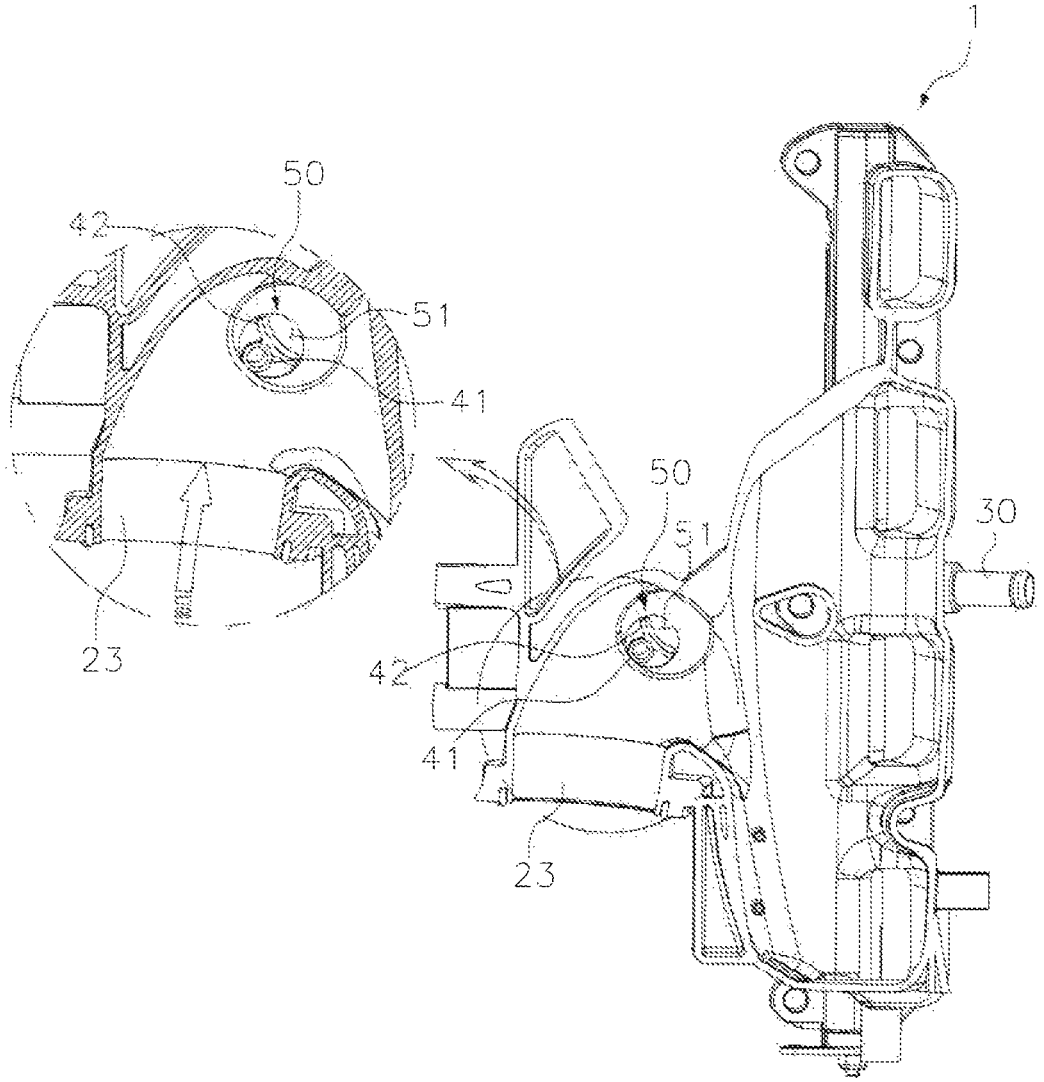
FIG. 9 is a cross-sectional view of the intake manifold with a unified flow path according to an embodiment of the present invention.

FIG. 8 is a cross-sectional perspective view of the surge tank unit 20 of the intake manifold 1 with a unified flow path according to an embodiment of the present invention and FIG. 9 is a cross-sectional view of the intake manifold 1 with a unified flow path according to an embodiment of the present invention.

Referring to FIGS. 8 and 9, the gas outlet 41 is disposed fully inside the unified gas inlet 50 is divided into a blow-by gas intake portion 51, through which blow-by gas flows inside, by the anti-backflow wall 42.

The blow-by gas flowing into the surge tank unit 20 through the blow-by gas flow path 21*a* is mixed with the fuel evaporation gas flowing into the surge tank unit 20 through the gas outlet 41 in the unified gas inlet 50 and then discharged.

When high-temperature blow-by gas and fuel evaporation gas at relatively low temperature are mixed, the gas mixture flows into the surge tank unit 20 with the temperature reduced, so condensate water that is produced when the blow-by gas is mixed with cold external air flowing inside through the external inlet 23 is minimized.

Further, the gas outlet 41 is disposed close to the external air 23 inside the unified gas inlet 50 and the blow-by gas intake portion 51 may be disposed behind the gas outlet 41 inside the unified gas inlet 50.

Blow-by gas is guided to the unified gas inlet 50 through the blow-by gas flow path 21*a* and then discharged in the direction A through the gas outlet 41, fuel evaporation gas is discharged in the direction B through the PCSV connector 40, that is, through the portion divided by the anti-backflow wall 42 inside the unified gas inlet 50, and external air sequentially comes in contact with the blow-by gas and the fuel evaporation gas while flowing in the direction C into the surge tank unit 20.

That is, when cold external air flows inside through the external air inlet 23 in winter, the external air is primarily heated by the fuel evaporation gas discharged through the gas outlet 41 and then mixed with the high-temperature blow-by gas flowing inside through the blow-by gas intake portion 51, so condensate water that is produced when the cold external air and the blow-by gas are mixed is further minimized.

Accordingly, it is possible to prevent freezing of the condensate water that is produced when cold external air and blow-by gas are mixed.

According to the present invention, since blow-by gas and fuel evaporation gas flow together inside through one gas inlet formed at the external inlet 23 of the surge tank unit 20, flow resistance when external air flows inside is reduced.

Further, since flow resistance when external air flows into the surge tank unit 20 is reduced, a loss of pressure of the external air is minimized and the amount of air to be supplied into the cylinders of an automotive engine is correspondingly increased. Accordingly, the volume efficiency of the cylinders is improved and engine torque is increased.

Further, since blow-by gas and fuel evaporation gas flow together inside through one gas inlet formed at the external air inlet 23 of the surge tank unit 20, high-temperature blow-by gas is primarily cooled while being mixed with fuel evaporation gas and then meets external air. Accordingly, condensate water is prevented and freezing of condensate water is correspondingly prevented in winter.

Further, blow-by gas is smoothly guided by preventing freezing at the blow-by gas inlet in winter, so the amount of air to be supplied into the cylinders of an automotive engine is increased. Accordingly, the volume efficiency of the cylinders is improved and engine torque is increased.

Further, since the PCSV connector 40 is integrated with the gas cap member for covering the blow-by gas flow path 21*a* for guiding blow-by gas to the inlet for external air, molds are unified in a single unit and the manufacturing process is correspondingly simplified. Accordingly, the manufacturing cost is reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An intake manifold for a vehicle with a unified flow path, the intake manifold having a plurality of branch pipes, and a surge tank unit connected to the branch pipes and having an external air inlet formed at a side to receive external air, wherein the surge tank unit has a unified gas inlet formed at the external air inlet so that blow-by gas and fuel evaporation gas both flows inside, wherein the intake manifold has a PCV valve connector protruding to mount a positive crankcase ventilation (PCV) valve for receiving blow-by gas into the surge tank unit and a PCSV connector protruding to mount a purge control solenoid valve (PCSV) for receiving fuel evaporation gas into the surge tank unit, wherein a flow path wall forming a blow-by gas flow path connected to the PCV valve connector, and guiding blow-by gas, which flows inside through the PCV valve connector, into the external inlet of the surge tank unit is formed in the surge tank unit, the unified gas inlet is formed at an end of the flow path wall, and an outlet of the PCSV connector is disposed inside the unified gas inlet, wherein the PCSV connector has an anti-backflow wall protruding at a joint with the outlet of the PCSV connector in a gas flow direction inside the blow-by gas flow path to guide the blow-by gas to the unified gas inlet.

2. The intake manifold of claim 1, wherein a gas cap member for opening and closing the blow-by gas flow path is coupled to the surge tank unit and the PCSV connector is integrally formed with the gas cap member.

3. The intake manifold of claim 2, wherein the PCSV connector is disposed at a portion, which corresponds to the unified gas inlet, of the gas cap member.

4. The intake manifold of claim 1, wherein the PCSV connector has a gas outlet protruding inside the unified gas inlet.

5. The intake manifold of claim 4, wherein the gas outlet is disposed fully inside the unified gas inlet.

6. The intake manifold of claim 4, wherein the gas outlet is disposed at the external air inlet in the unified gas inlet and a blow-by gas intake portion is disposed behind the gas outlet in the unified gas inlet.

* * * * *